US006375528B1

(12) United States Patent
Neisen

(10) Patent No.: US 6,375,528 B1
(45) Date of Patent: Apr. 23, 2002

(54) ADJUSTABLE VARIABLE VENT OPENING PLUGS FOR ENGINE EXHAUST

(75) Inventor: Gerald F. Neisen, Rockport, TX (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/547,591

(22) Filed: Apr. 11, 2000

(51) Int. Cl.[7] ..... B63H 21/38
(52) U.S. Cl. ..... 440/89; 416/93 M
(58) Field of Search ..... 416/93 R, 93 A, 416/93 M; 440/89; 220/360, 367.1

(56) References Cited

U.S. PATENT DOCUMENTS 3,434,447 A * 3/1969 Christensen et al. ..... 416/93 M
4,545,771 A * 10/1985 Iio ..... 416/93 A
4,802,872 A * 2/1989 Stanton ..... 416/93 A
5,797,791 A * 8/1998 Humphrey et al. ..... 454/134
5,916,003 A * 6/1999 Masini et al. ..... 416/93 A
6,010,380 A * 1/2000 Wollard ..... 440/89

* cited by examiner

*Primary Examiner*—Sherman Basinger
(74) *Attorney, Agent, or Firm*—Armstrong Teasdale LLP

(57) ABSTRACT

A vent plug includes a main body configured to be secured within an opening in a wall of a gear case in flow communication with an exhaust passageway through the gear case. The vent plug main body includes a flow passage therethrough and a planar flow restriction member extends across the flow passage that includes an opening. The main body also includes a variable flow restriction member chamber having an annular groove extending around the chamber. A variable flow restriction member is located in the chamber, and includes an opening having the same diameter as the diameter of the opening in the flow restriction member. The variable flow restriction chamber is movable within the chamber groove to adjust an amount of exhaust passing through the openings of the flow restriction member and the variable flow restriction member.

46 Claims, 3 Drawing Sheets

ADJUSTABLE VARIABLE VENT OPENING PLUGS FOR ENGINE EXHAUST

BACKGROUND OF THE INVENTION

The invention relates generally to marine engines, and more particularly, to controlling exhaust venting.

Outboard engines include a drive shaft which extends from the engine power head, through an exhaust case, and into an engine lower unit. The lower unit includes a gear case, and a propeller shaft extends through the gear case. Forward and reverse gears couple the propeller shaft to the drive shaft. The drive shaft, gears, and propeller shaft sometimes are referred to as a drive train.

An exhaust path extends from the power head through the exhaust case. The gear case includes an exhaust passageway, and at least some types of propellers include an outer hub through which exhaust gases are discharged. In operation, exhaust from the power head flows through the exhaust case, the gear case passageway, and the propeller.

To increase acceleration of the engine from an idle condition, it is known to provide vent openings in the propeller or gear case so that some exhaust is discharged through the vent openings and into a region adjacent blades of the propeller. By displacing at least some of the water adjacent the propeller blades, the propeller is more easily accelerated. That is, the propeller blades more easily move through an exhaust-water combination rather than only water.

Known vent openings have fixed dimensions and are not readily adjustable. For example, vent openings in a propeller typically are drilled or machined in the propeller. Such openings have fixed dimensions, e.g., a fixed diameter. Plugs may be utilized to completely close the vent openings. An operator therefore can select whether to operate with the plugs in place, i.e., no venting of exhaust gases, or without the plugs, i.e., full venting of the exhaust gases.

It also is known to provide an assortment of plugs for propeller vent openings that have pre-defined fixed dimensioned openings therethrough. The propeller plugs are interchangeable so that an operator can select an amount of venting by selecting a plug having an opening size corresponding to the desired amount of venting.

Propeller vent openings are typically located adjacent each blade. For a four blade propeller, for example, four vent openings are located in the propeller with each vent opening being adjacent one blade. In addition, for consistent performance, the size of the vent openings should be the same at each propeller blade. Otherwise, the blades will be subjected to different operating conditions which can result in variable, and degraded, performance of the propeller.

With the interchangeable, fixed dimension propeller vent plugs described above, an operator may possibly purchase and test multiple sets of vent plugs. For example, an operator may purchase three or more sets of four vent plugs for a four blade propeller, and test each set of plugs to determine which set provides the desired performance. Once the plugs are tested by the operator and one set of plugs is selected, the other plugs which the operator determines not to use probably are not returnable since the plugs will have been used and may show some wear. In addition, retailers would have to stock many different vent plugs having different sized vent openings.

BRIEF SUMMARY OF THE INVENTION

A vent plug that includes a user adjustable, variable sized vent opening is described herein. Rather than being removable and replaced with a plug with a different sized opening, the present vent plug is fixed in place and is not ordinarily removed except in circumstances of repair. A user need not remove the vent plug in order to adjust the size of the vent opening.

More specifically, and in an exemplary embodiment, the vent plug includes a main body configured to be snap-fit and secured within an opening in a wall of a gear case in flow communication with an exhaust passageway through the gear case. The vent plug main body also can be configured to be snap-fit and secured within an opening in a propeller hub and in flow communication with an exhaust passageway through the propeller.

The vent plug main body also includes a flow passage therethrough. The flow passage extends from an inlet side of the main body to an outlet side of the main body. A planar flow restriction member extends across the flow passage, and an opening extends through the flow restriction member. The size of the opening in the flow restriction member limits the maximum amount of exhaust which can be discharged through the vent plug.

The main body also includes a variable flow restriction member chamber. In the exemplary embodiment, the chamber has a generally circular cross sectional shape. An annular groove in the main body member extends around the chamber.

A variable flow restriction member is located in the chamber, and in one embodiment, the member is a disk having an annular ridge at its periphery. An opening extends through the disk, and the disk opening has the same diameter as the diameter of the opening in the flow restriction member. The disk is movable within the chamber with the disk ridge moving within the chamber groove.

When the disk opening is coaxially aligned with the flow restriction member opening, the plug is in a fully open position so that maximum exhaust flows through the plug. When the disk opening is not overlapping the flow restriction member opening, then the plug is in a fully closed position. When the disk opening partially overlaps the flow restriction member opening, then the plug is in a partially open position so that at least some exhaust flows through the plug. The disk is adjustable to various positions between the fully closed and the fully open position to enable an operator to select an exhaust flow which results in the desired performance.

The above described vent plug including the user adjustable, variable sized vent opening enables a user to select a specific amount of exhaust flow for a particular engine without requiring the purchase and test of multiple sets of vent plugs. In addition, retailers do not have to stock many different vent plugs having different sized vent openings. Rather, retailers can stock only the above described vent plug.

DETAILED DESCRIPTION OF THE INVENTION

The various embodiments of vent plugs described below are not limited to practice in connection with a particular engine, nor are such plugs limited to practice with a particular gear case or propeller. The vent plugs can be utilized in connection with many engines, including many gear cases and propellers. Therefore, although vent plugs are described below in the context of an exemplary outboard engine and gear case and propeller, the vent plugs are not limited to practice with such engine, gear case and propeller.

Figure 1:
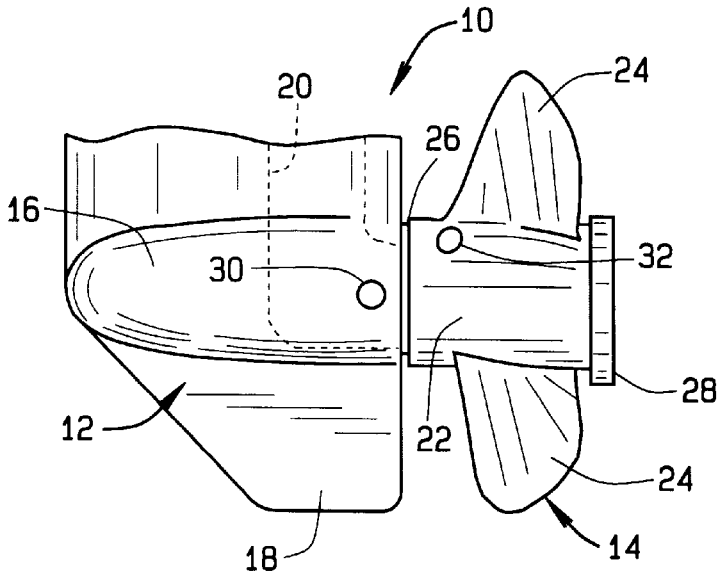
FIG. 1 is a fragmentary view of the lower unit of a marine propulsion device which includes a through-the-hub exhaust.

FIG. 1 is a fragmentary view of a lower unit 10 of a marine propulsion device which includes a gear case 12 and a propeller 14 having a through-the-hub exhaust. Gear case 12 includes a bullet portion 16 and a skeg 18. An exhaust passageway 20 extends through lower unit to propeller 14.

Propeller 14 includes a hub 22 and a plurality of blades 24 extending from hub 22. Exhaust flows from exhaust passageway 20 in gear case 12 and through hub 22. Specifically, exhaust flows from an upstream end 26 to a downstream end 28 of propeller 14, and the exhaust is discharged at propeller downstream end 28.

A vent opening 30 in gear case 12 and a vent opening 32 in propeller hub 22 are shown in FIG. 1. In actual practice, typically either one or more vent openings 30 are in gear case 12 (e.g., one vent opening 30 in each opposing side of gear case 12), or vent openings 32 are in propeller 12 (e.g., one vent opening 32 associated with each propeller blade). The present vent plugs are not limited to use in any one specific location in a gear case 12 or propeller 12, and can be utilized in various locations.

As explained above, and in operation, exhaust is discharged through vent openings 30 and/or 32 and into a region adjacent blades 24 of propeller 14. By displacing at least some of the water adjacent propeller blades 24, propeller 14 more easily accelerates. That is, propeller blades 24 more easily move through an exhaustwater combination rather than only water.

Figure 2:
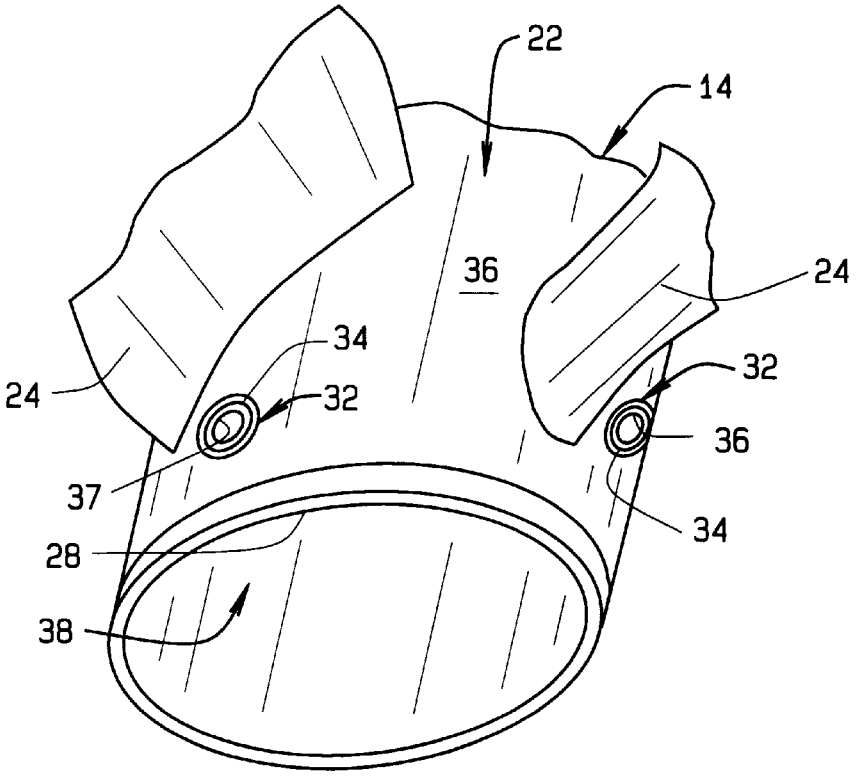
FIG. 2 is a fragmentary view of a propeller including openings for receiving vent plugs.

FIG. 2 is a fragmentary schematic view of propeller 14 including vent openings 32 for receiving vent plugs, which are described below in detail. Openings 32, in the exemplary embodiment shown in FIG. 2, have a recessed surface 34 in which the vent plug is inserted so that only a portion of the vent plug extends beyond an outer surface 36 of hub 22. Recessed surface 34 has a greater outer diameter than an outer diameter of through-hole 37 which extends completely through hub 22 and into flow communication with an exhaust passage 38 through propeller 14.

Vent openings 32 in propeller 14 are located adjacent each blade 24. If propeller 14 is a four blade propeller, for example, four vent openings 32 are located in propeller 14 with one vent opening 32 adjacent each blade 24. In addition, for consistent performance, the diameter of vent through-hole 37 is the same at each propeller blade 24 to facilitate subjecting each blade 24 to the same operating conditions.

Figure 3:
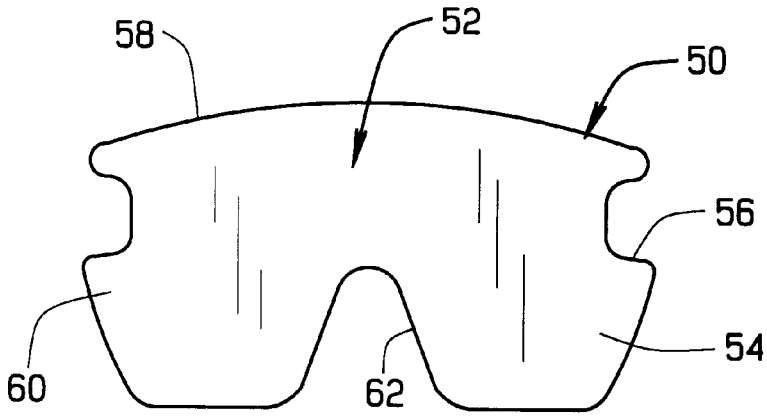
FIG. 3 is a side view of a vent plug in accordance with one embodiment of the present invention.

FIG. 3 is a side view of a vent plug 50 in accordance with one embodiment of the present invention. Vent plug 50 is configured to be fixed in place with respect to, for example, a propeller or a gear case, and is not ordinarily removed except in circumstances of repair. Vent plug 50 includes a main body 52 configured to be snap-fit and secured within openings 30 (gear case) and 32 (propeller). The vent plug main body 52 includes a snap-fit portion 54, an annular groove 56, and a domed portion 58. Snap-fit portion 54 includes a protrusion 60 which snaps through a vent opening and prevents plug 50 from being easily removed from the opening. Slots 62 in snap-fit portion 54 facilitate inserting portion 54 through the vent opening. Typically, two or four slots 62 are in portion 54. To facilitate fixing vent plug 50 within a propeller vent opening, protrusions 60 can be sized so that once in place, plug 50 is very securely and snugly fixed in position. For a gear case vent opening, for example, protrusion 60 can be sized so that plug 50 is removable.

Groove 56 is sized to receive, for example, a wall of the propeller or a wall of the gear case. The groove size is selected based on the wall thickness so that the wall fits snugly within groove 56. Domed portion 58 is rounded to facilitate the flow of water thereover. Specifically, domed portion 58 may at least partially extend, for example, beyond the outer surface of hub 22 and be in direct contact with the water flow.

Figure 4:
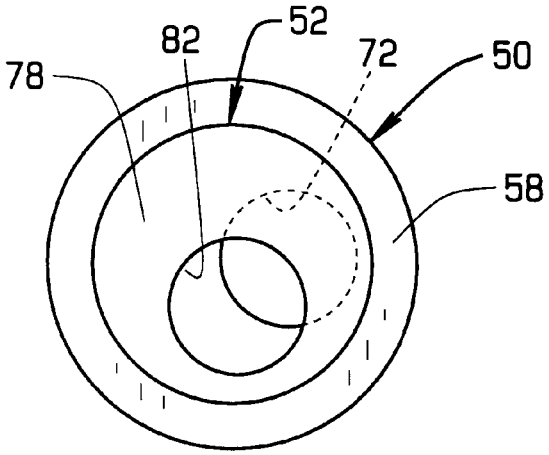
FIG. 4 is a top view of the vent plug shown in FIG. 3.
Figure 5:
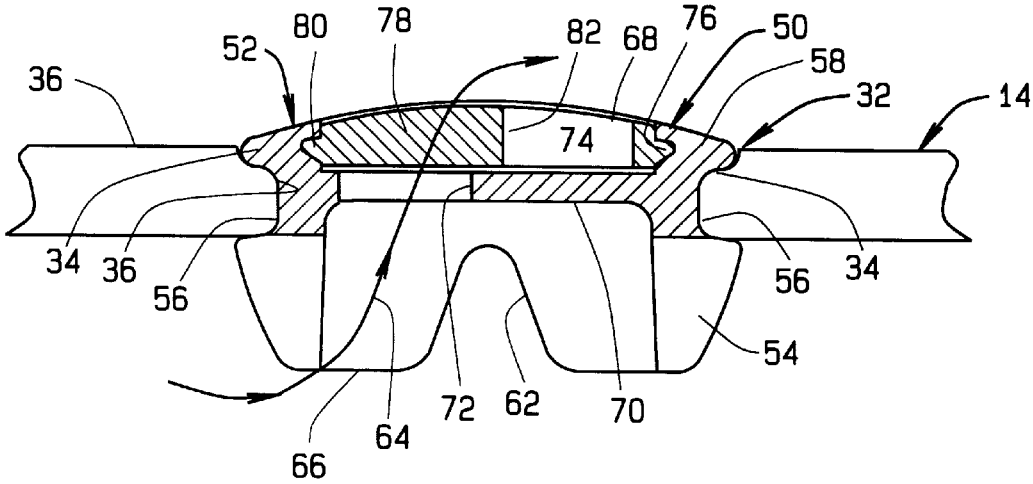
FIG. 5 is a cross-sectional view of the vent plug shown in FIG. 3.

FIG. 4 is a top view of vent plug 50, and FIG. 5 is a cross sectional view of plug 50 inserted within an opening 32 in propeller 14. The following description is in reference to both FIGS. 4 and 5. More specifically, vent plug main body 52 includes a flow passage 64 therethrough. Flow passage 64 extends from an inlet side 66 of main body 52 to an outlet side 68 of main body 52. A planar, fixed flow restriction member 70 extends across flow passage 64, and an opening 72 extends through flow restriction member 70. The size of opening 72 in fixed flow restriction member 70 limits a maximum amount of exhaust which can be discharged through vent plug 50.

Main body 52 also includes a variable flow restriction member chamber 74. Chamber 74 has a generally circular cross sectional shape. An annular groove 76 in main body 52 extends around chamber 74.

A variable flow restriction member 78 is located in chamber 74, and in one embodiment, member 78 is a disk having an annular ridge 80 at its periphery that fits in groove 76. An opening 82 extends through disk 78, and disk opening 82 has the same diameter as a diameter of opening 72 in flow restriction member 70. Disk 78 is movable within chamber 74 with disk ridge 80 moving within chamber groove 76.

When disk opening 82 is coaxially aligned with flow restriction member opening 72, plug 50 is in a fully open position so that maximum exhaust flows through plug 50. When disk opening 82 is not overlapping flow restriction member opening 72, then plug 50 is in a fully closed positioned so that no exhaust flows through plug 50. When disk opening 82 partially overlaps flow restriction member opening 72, then plug 50 is in a partially open position so that at least some exhaust flows through plug 50. Disk 78 is adjustable to various positions between the fully closed and the fully open position to enable an operator to select an optimum exhaust flow. Once set to the desired position, friction between disk 78 and restriction member 70 keeps disk 78 in the selected position.

Plug 50 can be fabricated from material which facilitates snap-fitting plug 50 in place and that can withstand the operating conditions. Such materials include, for example, plastic and rubber. Both main body 52 and disk 78 can be molded, and then disk 78 is snapped in place in main body 52 so that ridge 80 extends within groove 76. Also, although plug 50 is illustrated herein as being round, the plug can have many different shapes.

The above described vent plug including the user adjustable, variable sized vent opening enables a user to select a specific amount of exhaust flow for a particular engine without requiring the purchase and test of multiple sets of vent plugs. In addition, retailers do not have to stock many different vent plugs having different sized vent openings. Rather, retailers only need to stock the above described vent plug.

Further, and if a need arises to adjust plug 50, a user can simply turn the disk to provide the desired exhaust flow. A need for such changes may arise due, for example, to a change in boat, load, altitude, or other operational conditions, e.g., to provide greater acceleration from idle for water skiing.

In addition, the above described vent plug is fixed within the vent opening and does not require removal, e.g., to insert a vent plug having a different diameter opening. Therefore, the mechanical structure for securing the vent plug within the vent opening can securely and permanently fix the vent plug in place as compared to interchangeable propeller vent plugs. By securely fixing the above described vent plug in place, the vent plug is less prone to being unintentionally ejected from the vent opening and possibly adversely impacting engine operation. As explained above, it may be desirable to provide that the vent plugs are removable from a gear case vent opening and the vent plug can be modified to facilitate such removal.

It is contemplated that the vent plugs could be sold in kit form. For example, a propeller having a plurality of vent openings along with a number of vent plugs at least equal to the number of propeller vent openings could be packaged and sold in the form of a kit. The vent plugs also could be sold in kit form with a gear case. As with the propeller, the number of vent plugs packaged and sold in kit form with the gear case would at least be equal to the number of gear case vent openings. The vent plugs also could be packaged and sold by themselves in kit form.

From the preceding description of various embodiments of the present invention, it is evident that the objectives of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A vent plug, comprising:

a main body having a flow passage therethrough and a flow restriction member limiting flow through said passage;

a variable flow restriction member in flow communication with said main body flow passage, said variable flow restriction member comprising an opening therethrough, said variable flow restriction member movable relative to said main body and extendable over said flow restriction member to at least selectively restrict exhaust flow through said flow passage; and a variable flow restriction member chamber, an annular groove in said main body extending around said chamber.

2. A vent plug in accordance with claim 1 wherein said main body comprises a snap-fit portion for being inserted through an opening.

3. A vent plug in accordance with claim 2 wherein said snap-fit portion comprises a protrusion which prevents said plug from easily being removed from within the opening.

4. A vent plug in accordance with claim 1 further comprising an annular groove and a domed portion, said annular groove sized to receive a wall of a structure through which the opening extends.

5. A vent plug in accordance with claim 1 further comprising a fixed flow restriction member extending across said flow passage, and an opening through said fixed flow restriction member through which the exhaust flows.

6. A vent plug in accordance with claim 5 wherein a diameter of said fixed flow restriction member limits maximum exhaust flow which can be discharged through said vent plug.

7. A vent plug in accordance with claim 1 wherein said variable flow restriction member chamber has a circular cross sectional shape.

8. A vent plug in accordance with claim 7 wherein said variable flow restriction members is located in said chamber.

9. A vent plug in accordance with claim 8 wherein said variable flow restriction member comprises a disk having an annular ridge extending into said groove in said main body extending around said chamber.

10. A vent plug in accordance with claim 9 further comprising a fixed flow restriction member extending across said flow passage, and an opening through said fixed flow restriction member through which the exhaust flows, and wherein an opening extends through said disk, said disk movable within said chamber with said disk ridge moving within said chamber groove.

11. A vent plug in accordance with claim 10 wherein said disk opening has a same diameter as a diameter of said opening in said fixed flow restriction member.

12. A vent plug in accordance with claim 10 wherein when disk opening is coaxially aligned with said flow restriction member opening, said plug is in a fully open state so that maximum exhaust flows through said plug, and when said disk opening is not overlapping said flow restriction member opening, said plug is in a fully closed condition.

13. A vent plug in accordance with claim 12 wherein when said disk opening partially overlaps said flow restriction member opening, said plug is in a partially open condition.

14. A vent plug in accordance with claim 13 wherein said disk is adjustable between said fully closed and said fully open condition.

15. A vent plug in accordance with claim 14 wherein friction between said disk and said restriction member maintains said disk in a selected position.

16. A vent plug in accordance with claim 1 wherein said main body and said variable flow restriction member are fabricated from at least one of plastic and rubber.

17. A vent plug in accordance with claim 1 wherein said main body and said variable flow restriction member have a substantially circular cross sectional shape.

18. A vent plug, comprising:

a main body having a flow passage therethrough and a flow restriction member limiting flow through said flow passage;

a variable flow restriction member for controlling exhaust flow through said main body, said variable flow restriction member comprising an opening therethrough, said variable flow restriction member movable to a fully open position so that maximum exhaust flows through said flow passage, a fully closed position to substantially block exhaust flow through said flow passage, and positions intermediate said fully open position and said fully closed position; and a variable flow restriction member chamber, said variable flow restriction member located in said chamber.

19. A vent plug in accordance with claim 18 further comprising a fixed flow restriction member extending across said flow passage, and an opening through said fixed flow restriction member through which the exhaust flows, a diameter of said fixed flow restriction member limits maximum exhaust flow which can be discharged through said vent plug.

20. A vent plug in accordance with claim 18 wherein said variable flow restriction member comprises a disk having an opening therethrough.

21. A vent plug in accordance with claim 20 further comprising a fixed flow restriction member extending across said flow passage, and an opening through said fixed flow restriction member through which the exhaust flows.

22. A vent plug in accordance with claim 21 wherein said disk opening has a same diameter as a diameter of said opening in said fixed flow restriction member.

23. A vent plug in accordance with claim 21 wherein when said disk opening is coaxially aligned with said flow restriction member opening, said plug is in a fully open state so that maximum exhaust flows through said plug, and when said disk opening is not overlapping said flow restriction member opening, said plug is in a fully closed condition.

24. A vent plug in accordance with claim 23 wherein said disk is adjustable between said fully closed and said fully open condition.

25. A vent plug in accordance with claim 21 wherein when said disk opening partially overlaps said flow restriction member opening, said plug is in a partially open condition.

26. A gear case for a marine engine, said gear case having an exhaust passage therethrough, a vent opening extending through a side wall of said gear case and in flow communication with said exhaust passage, and a removable vent plug inserted within said vent opening, wherein said vent plug comprises a main body having a flow passage therethrough and a fixed flow restriction that limits flow through said flow passage, and a variable flow restriction member having an opening therethrough and located in a variable flow restriction member chamber, a position of said variable flow restriction opening adjustable relative to said fixed flow restriction opening for controlling exhaust flow through said main body, said variable flow restriction member movable to a fully open position so that maximum exhaust flows through said flow passage, a fully closed position to substantially block exhaust flow through said flow passage, and positions intermediate said fully open position and said fully closed position.

27. A vent plug in accordance with claim 26 further comprising a fixed flow restriction member extending across said flow passage, and an opening through said fixed flow restriction member through which the exhaust flows, a diameter of said fixed flow restriction member limits maximum exhaust flow which can be discharged through said vent plug.

28. A gear case in accordance with claim 27 wherein said variable flow restriction member comprises a disk having an opening therethrough.

29. A gear case in accordance with claim 28 wherein when disk opening is coaxially aligned with said flow restriction member opening, said plug is in a fully open state so that maximum exhaust flows through said plug, and when said disk opening is not overlapping said flow restriction member opening, said plug is in a fully closed condition.

30. A gear case in accordance with claim 28 wherein when said disk opening partially overlaps said flow restriction member opening, said plug is in a partially open condition.

31. A gear case in accordance with claim 28 wherein said disk is adjustable between said fully closed and said fully open condition.

32. A propeller for a marine engine, said propeller comprising a hub and a plurality of blades extending from said outer hub, at least one vent opening in said propeller hub, a vent plug inserted within said vent opening, said vent plug comprising:

a main body having a flow passage therethrough and a fixed flow restriction opening;

a variable flow restriction member for controlling exhaust flow through said main body, said variable flow restriction member movable relative to said fixed flow restriction opening to a fully open position so that maximum exhaust flows through said flow passage, a fully closed position to substantially block exhaust flow through said flow passage, and positions intermediate said fully open position and said fully closed position; and a variable flow restriction member chamber, said variable flow restriction member located in said chamber.

33. A propeller in accordance with claim 32 wherein said vent plug further comprises a fixed flow restriction member extending across said flow passage, and an opening through said fixed flow restriction member through which the exhaust flows, a diameter of said fixed flow restriction member limits maximum exhaust flow which can be discharged through said vent plug.

34. A propeller in accordance with claim 33 wherein said variable flow restriction member comprises a disk having an opening therethrough.

35. A propeller in accordance with claim 34 wherein when disk opening is coaxially aligned with said flow restriction member opening, said plug is in a fully open state so that maximum exhaust flows through said plug, and when said disk opening is not overlapping said flow restriction member opening, said plug is in a fully closed condition.

36. A propeller in accordance with claim 34 wherein when said disk opening partially overlaps said flow restriction member opening, said plug is in a partially open condition.

37. A propeller in accordance with claim 34 wherein said disk is adjustable between said fully closed and said fully open condition.

38. A kit comprising at least one vent plug, said vent plug comprising a main body having a flow passage therethrough and a fixed flow restriction opening, and a variable flow restriction member having an opening therethrough for controlling exhaust flow through said main body and located in a variable flow restriction member chamber, said variable flow restriction member opening and said fixed flow restriction opening movable relative to one another to a fully open position so that maximum exhaust flows through said flow passage, a fully closed position to substantially block exhaust flow through said flow passage, and positions intermediate said fully open position and said fully closed position.

39. A kit in accordance with claim 38 further comprising a propeller having a plurality of vent openings therein, a number of vent plugs being no less than a number of vent opening in said propeller.

40. A kit in accordance with claim 39 further comprising a gear case having at least one vent opening therein, a number of vent plugs being no less than a number of vent opening in said propeller.

41. A method for adjusting exhaust flow through a marine engine, the marine engine having a gear case and a propeller, an exhaust flow path extending through the gear case and the propeller, at least one vent plug in flow communication with the exhaust flow path, the vent plug having a flow passage therethrough and a flow restriction opening therein, and a variable flow restriction member in flow communication with the vent plug flow passage and having an opening therethrough, the variable flow restriction member opening movable relative to the vent plug and extendable over the flow restriction opening, said method comprising the step rotating the variable flow restriction member to adjust an overlap of the flow restriction opening and the valuable flow restriction member opening.

42. A method in accordance with claim 41 wherein the vent plug includes a snap-fit portion for being inserted through an opening, the snap-fit portion including a protrusion, said method further comprising the steps of preventing the plug from easily being removed from within the opening by maintaining the protrusion within the opening.

43. A method in accordance with claim 41 wherein the variable flow restriction member is a disk, said method of rotating the variable flow restriction member further comprising the step of rotating the disk.

44. A method in accordance with claim 43 wherein the disk includes an opening, the disk opening having a same diameter as a diameter of a fixed flow restriction member opening, said method further comprising the step of aligning the disk opening with the fixed flow restriction member opening in a fully open state so that maximum exhaust flows through the plug.

45. A method in accordance with claim 43 wherein the disk includes an opening, the disk opening having a same diameter as a diameter of a fixed flow restriction member opening, said method further comprising the step of overlapping the fixed flow restriction member opening and the disk opening in a partially open condition.

46. A method in accordance with claim 43 wherein the disk includes an opening, the disk opening having a same diameter as a diameter of a fixed flow restriction member opening, said method further comprising the step of adjusting said disk so that the disk opening does not overlap the fixed flow restriction member opening, thereby closing the flow passage.

* * * * *